US007596328B2

(12) United States Patent
Barbera et al.

(10) Patent No.: US 7,596,328 B2
(45) Date of Patent: Sep. 29, 2009

(54) EFFICIENT SENSING SYSTEM

(75) Inventors: Joseph D Barbera, LaCenter, WA (US); Aaron B. Weast, Camas, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 1149 days.

(21) Appl. No.: 10/421,580

(22) Filed: Apr. 22, 2003

(65) Prior Publication Data

US 2004/0213589 A1 Oct. 28, 2004

(51) Int. Cl.
*G03G 15/00* (2006.01)

(52) U.S. Cl. ..... 399/18; 399/16

(58) Field of Classification Search ..... 399/16–18, 399/23, 361, 371; 271/258.01, 258.04, 259, 271/265.01, 265, 258
See application file for complete search history.

(56) References Cited

U.S. PATENT DOCUMENTS 4,088,411 A * 5/1978 Ahlquist et al. ..... 356/634
4,538,515 A * 9/1985 Tymkewicz et al. ..... 101/216
4,598,363 A * 7/1986 Clark et al. ..... 710/46
4,638,732 A * 1/1987 Salazar et al. ..... 101/91
4,641,070 A * 2/1987 Pfizenmaier et al. ..... 318/640
4,694,153 A * 9/1987 Bejczy et al. ..... 250/202
5,078,378 A * 1/1992 Kapadia et al. ..... 271/3.04
5,358,229 A * 10/1994 Groel et al. ..... 271/3.06
5,410,157 A * 4/1995 Davis ..... 250/559.19
5,464,206 A * 11/1995 Rodi et al. ..... 271/227
5,488,458 A * 1/1996 Benedict et al. ..... 399/15
5,586,755 A * 12/1996 Hansen ..... 271/9.06
5,654,554 A * 8/1997 Feller et al. ..... 250/559.45
5,692,741 A * 12/1997 Nakamura et al. ..... 271/10.03
5,699,735 A * 12/1997 Stein et al. ..... 101/219
6,023,034 A * 2/2000 Nakajima et al. ..... 209/584
6,064,629 A * 5/2000 Stringer et al. ..... 367/128
6,076,460 A * 6/2000 Kagawa ..... 101/128.4
6,078,678 A * 6/2000 Gavrilos ..... 382/101
6,126,160 A * 10/2000 Ebert et al. ..... 271/10.03
6,253,159 B1 * 6/2001 Bett et al. ..... 702/85
6,330,422 B1 * 12/2001 Sato et al. ..... 399/382
6,651,980 B2 * 11/2003 Isemura et al. ..... 271/259
2002/0018055 A1 * 2/2002 Smith et al. ..... 345/204

FOREIGN PATENT DOCUMENTS

GB 2170934 A * 8/1986

* cited by examiner

*Primary Examiner*—Anthony H. Nguyen

(57) ABSTRACT

An efficient sensing system. The efficient sensing system includes a first mechanism for sensing and a second mechanism for sensing. A third mechanism selectively polls the second mechanism upon receipt of a signal from the first mechanism. In a specific embodiment, the first mechanism includes an early warning sensor, and the second mechanism includes an accurate sensor. In the specific embodiment, the third mechanism includes a controller in communication with the accurate sensor and the early warning sensor. The controller samples the accurate sensor at the sampling rate in response to the signal.

28 Claims, 2 Drawing Sheets

EFFICIENT SENSING SYSTEM

BACKGROUND OF THE INVENTION

1. Field of Invention

This invention relates to sensors. Specifically, the present invention relates to systems and methods for facilitating efficient sensing of objects or conditions, such as sensing print media, a print media path, and/or a print media position or edge thereof in a printer.

2. Description of the Related Art

Sensors, such as print media sensors, are employed in various demanding applications including sensing when a printer is out of paper and sensing paper location.

Accurate and efficient sensors are particularly important in edge-to-edge printing systems, also called full-bleed or zero-margin printing systems, which require very accurate paper edge detection and location. If a paper edge is inaccurately located, the image may extend beyond the paper edge, or undesirable strips may occur between the image and the edge of the page.

Conventionally, sensors positioned along a print media path are periodically polled to facilitate print media edge-detection. However, when no print media is present in the paper path, or when the media is present but not near the trailing edge, excess sensor polling consumes valuable printer processing time. Consequently, less printer processor/firmware time is available for performing other important printing tasks.

Hence, a need exists in the art for an efficient system and method for reducing excess sensor polling.

SUMMARY OF THE INVENTION

The need in the art is addressed by the efficient sensing system of the present invention. In the illustrative embodiment, the inventive sensing system is adapted for use in detecting print media edges in printing applications. The system includes a first mechanism for sensing and a second mechanism for sensing. A third mechanism selectively polls the second mechanism upon receipt of a signal from the first mechanism.

In a specific embodiment, the first mechanism includes an early warning sensor and the second mechanism is an accurate sensor. In the specific embodiment, the system further includes a controller in communication with the accurate sensor and the early warning sensor. The controller samples the sensor at the sampling rate in response to the signal. The controller includes a mechanism for increasing the sampling rate in response to the signal when the signal indicates detection of the object or condition by the early warning sensor. The early warning sensor includes a first emitter that transmits a first beam toward a detector. The first beam is associated with a first sensing region. The accurate sensor includes a second emitter that transmits a second beam toward the detector. The second beam is associated with a second sensing region.

In a more specific embodiment, the object or condition includes a leading edge or trailing edge of print media. The first sensing region is positioned before the second sensing region in a print media path associated with the print media. The controller further includes a mechanism for adjusting a sampling rate of the early warning sensor based on a signal received via the accurate sensor.

The novel design of sensing systems constructed in accordance with teachings of the present invention is facilitated by use of the early warning sensor and, in some embodiments, the use of a single detector to implement both the early warning sensor and the accurate sensor. In particular, use of the early-warning sensor in combination with the accurate edge sensor may reduce overall sensor polling while maintaining very accurate print media edge-detection. Higher frequency polling of an accurate edge-sensor may be performed when a print media edge is approaching as determined by the early-warning sensor, which may be polled at an efficient, low frequency. In addition, possible edge-detection accuracy by the accurate media edge sensor may be enhanced, since the media edge-sensor may be polled at a higher frequency than would other wise be possible. In previous edge-detection systems, very high frequency polling of an edge-sensor could consume excessive system resources at the expense of critical printing functions. Furthermore, in some embodiments or implementations of the present invention, use of a single detector to implement two sensors may minimize system costs.

DESCRIPTION OF THE INVENTION

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

Figure 1:
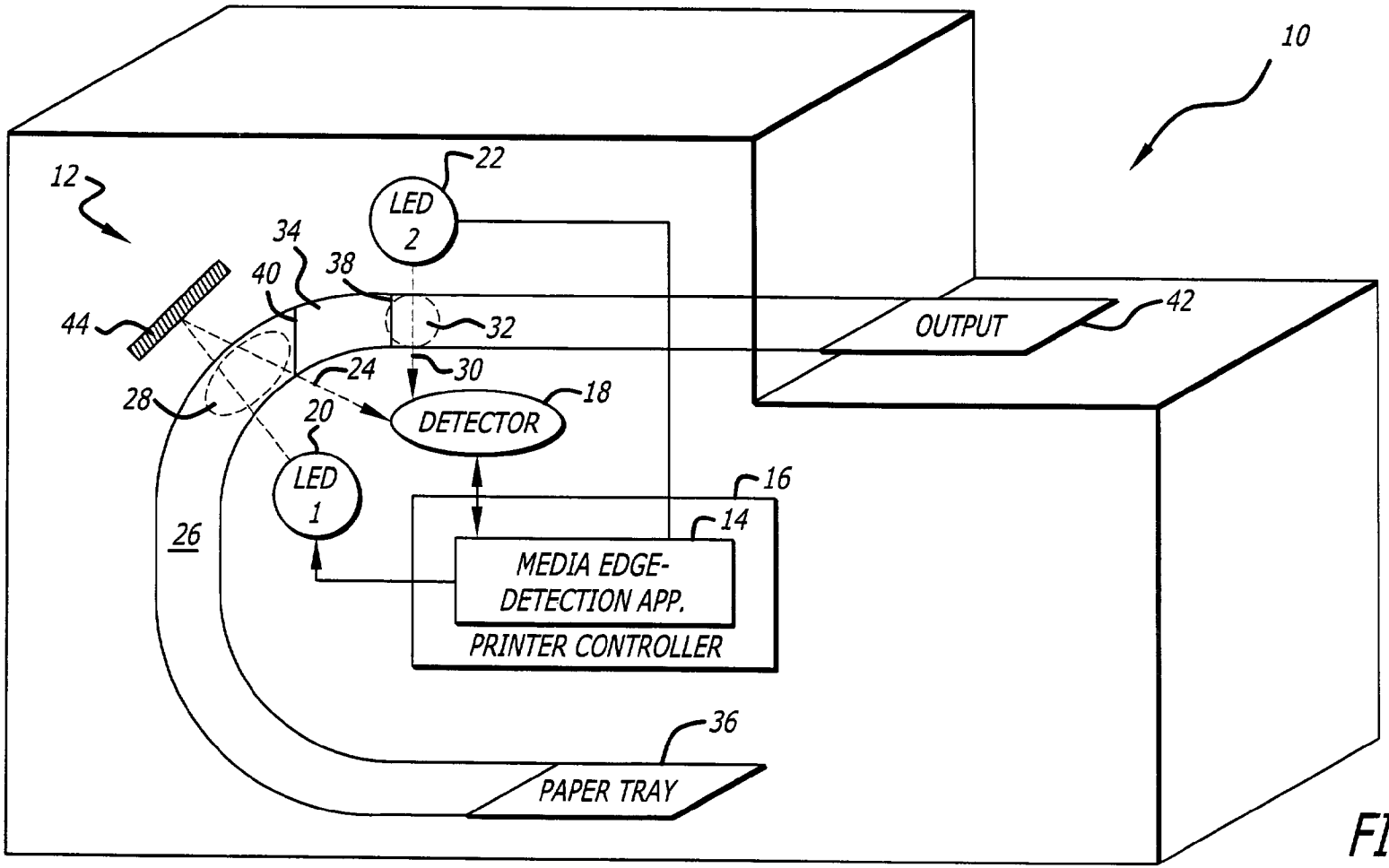
FIG. 1 is a diagram of a printer employing a print media edge-detection system constructed in accordance with the teachings of the present invention.

FIG. 1 is a diagram of a printer 10 employing a print media edge-detection system 12 constructed in accordance with the teachings of the present invention. For clarity, various components, such as power supplies, operating systems, various rollers, electrophotographic drums or print heads, and so on, have been omitted from the figures. However, those skilled in the art with access to the present teachings will know which components to implement and how to implement them to meet the needs of a given application.

The edge-detection system 12 includes a media edge-detection application 14, which may be implemented in hardware, software, and/or firmware. The media edge-detection application 14 runs on a printer controller 16, which is often called the printer processor. The media edge-detection application 14 communicates with a detector 18. The detector 18 receives optical input from a first emitter Light Emitting Diode (LED 1) 20 and a second LED (LED2) 22, which are connected to and receive control input from the media edge-detection application 14.

In the present specific embodiment, the first LED 20 is positioned to direct a first optical beam 24 across a paper path 26 to a reflecting mirror 44 on an opposite side of the paper path. The first optical beam 24 then reflects back across the paper path 26 to the detector 18. The first optical beam 24 crosses the paper path 26 within a first sensing region 28. Alternatively, the sensing system 12 may be configured to be responsive to light reflected off the print media 34 itself rather than the mirror 44 or other discrete reflector.

The second LED 22 is positioned on an opposite side of the paper path 26 from the detector 18 and directs a second optical beam 30 across the paper path 26 to the detector 18. The second optical beam 30 passes through a second sensing region 32, which is positioned after the first sensing region 28 along the paper path 26.

The LED's 20 and 22 may be replaced with any applicable source for producing a beam of electromagnetic energy, such as any equivalent light source, without departing from the scope of the present invention. The detector 18 should be sensitive to the electromagnetic energy in the beams 24 and 30 and the beams 24 and 30 should be affected by the presence of the print media 34 in the sensing regions 28 and 32.

The combination of the second LED 22 and the detector 18 represent an accurate media edge-detection sensor that accurately senses print media edges 38, 40 passing through the second sensing region 32. Similarly, the combination of the first LED 20 and the detector 18 represent an early-warning sensor that provides early warning sensing of a leading edge 38 and a trailing edge 40 of print media 34 passing along the paper path 26, which originated from an input paper tray 36. The print media 34 exiting the print media path 26 and printer 10 becomes print media output 42.

The locations of the sensing regions 28, 30 are application-specific and may be adjusted by one skilled in the art to meet the needs of a given application. Furthermore, use of additional lenses, prisms, mirrors, and so on, may be employed by those skilled in the art to enhance positioning flexibility of the LED's 20 and 22 and the detector 18 in the printer 10. In addition, the LED's 20 and 22 may be replaced with other types of transmitters that transmit energy other than optical energy, such as infrared or microwave, without departing from the scope of the present invention.

In operation, print media 34 exits the input paper tray 36 in response to control signals (not shown) from the printer controller 16 in preparation for printing a desired image on the print media 34. The leading edge 38 of the print media 34 is sensed early in the paper path 26 via the first LED 20 and detector 18. The early warning sensor 18, 20 is polled by the media edge-detection application 14 at a relatively low frequency.

The accuracy with which a print media edge can be detected is related to the polling frequency of a sensor. Accuracy requirements for the early warning sensor 18, 20 are less stringent than the requirements for the media edge-detection sensor 18, 22. Therefore, the requisite polling frequency of the early-warning sensor 18, 20 is relatively low compared to the polling frequency associated with the accurate media edge-detection sensor 18, 22.

The media edge-detection application 14 receives different electrical signals output from the detector 18 in response to the different optical signals 24 and 30 from the first LED 20 and second Led 22, respectively. The optical signals 24 and 30 are sufficiently distinct to facilitate detector output signal differentiation by the media edge-detection application 14. The optical signals 24 may be distinct in terms of frequency, pulse rate, power level, amplitude modulation, specific times at which the optical signals are allowed to transmit, and so on. The media edge-detection application 14 may perform different tasks depending on which electrical signal (resulting from the first beam 24 and/or the second beam 30) is received, as discussed more fully below.

In the present embodiment, when the media edge-detection application 14 polls the early-warning sensor 18, 20, it activates the first LED 20, which then transmits the first optical signal 24 across the print media path 26 to the detector 18. An interruption or change in the optical signal 24 received by the detector 18 in response to polling of the early-warning sensor 18, 20, as measured by the media edge-detection application 14, indicates that one of the print media edges 38 or 40 has arrived at the first sensing region 28. Interruption of the electrical signal resulting from the first optical beam 24 is interpreted as an early warning signal from the detector 18 by the media edge-detection application 14. Interruption of the electrical signal resulting from the second optical signal 30 is interpreted as an edge-detection signal by the media edge-detection application 14.

Similarly, when the media edge-detection application 14 polls the accurate media edge-detection sensor 18, 22, it activates the second LED 22, which then transmits the second optical signal 30 across the print media path 26 to the detector 18. An interruption or change in the second optical signal 30 indicates the detection of one of the print media edges 38 or 40.

Alternatively, the LED's 20 and 22 may be constantly on. In this case, the output beams 24 and 30 are sufficiently distinct to enable the media edge-detection application 14 to determine when a print media edge 38 or 40 blocks one or more of the beams 24 and/or 30.

When a print media edge 38 or 40 is detected by the early-warning sensor 18, 20, or a predetermined time thereafter, polling of the early-warning sensor may stop, and polling of the accurate edge-detection sensor 18, 22 begins at a high frequency. The frequency at which the edge-detection sensor 18, 22 is polled depends on the desired edge-detection precision or accuracy for a given application. Higher frequency polling may result in more accurate media edge detection.

In the present specific embodiment, the accurate edge-detection sensor 18, 22 is only polled when the warning sensor 18, 20 indicates that one of the media edges 38 or 40 is approaching the second sensing region 32 associated with the edge-detection sensor 18, 22. During times when the edge-detection sensor 18, 22 is not being polled, the early-warning sensor 18, 20 is polled at a slow, predetermined rate, thereby conserving printer processing resources.

In certain applications, the polling of the edge-detection sensor 18, 22 is not stopped entirely, but is merely slowed down until the early-warning sensor 18, 20 detects an incoming media edge. Actual sensor polling frequencies, and adjustments made to the polling frequency of the edge-detection sensor 18, 22 in response to the detection of an incoming media edge by the early-warning sensor 18, 20, are application-specific and may be determined by one skilled in the art to meet the needs of a given application.

In cases where polling of the early-warning sensor 18, 20 is idle while polling of the accurate edge-detection sensor 18, 22 is active, the sensing regions 28 and 32 are spaced so that distance between the edges 38 and 40 (to be sensed) of the smallest print media is greater than the distance between the sensing regions 28 and 32 along the paper path 26. This ensures that the early-warning sensor 18, 20 will not miss a print media edge when the accurate edge-detection sensor 18, 22 is active.

Alternatively, polling of the early-warning sensor 18, 20 is continued at a predetermined frequency, and is not halted when polling of the accurate edge-detection sensor 18, 22 begins. Simultaneous polling of the early-warning sensor 18, 20 and the accurate edge-detection sensor 18, 22 is facilitated by the differences in the optical signals 24 and 30, which result in different electrical responses.

Sufficient differences in electrical responses may result even if the optical signals 24 and 30 are similar. For example, differentiable electrical responses may result if the sum of the electrical signals resulting from the signals 24 and 30 is less than the saturation voltage of the detector 18, or if the LED signals 24 and 30 are strategically pulsed.

The emitters 20 and 22 may transmit at different frequencies and/or may be transmitted at different times to enable the detector 18 and media edge-detection application 14 to readily distinguish which beams 24 or 30 are currently impinging on the detector 18. For example, the beams 24 and 30 may be pulsed at different frequencies or may be different colors. Furthermore, each beam 24 and 30 may transmit at intensities that do not saturate the detector 18. In this case, the media edge-detection application 14 can readily determine when both beams 24 and 30 are simultaneously impinging on the detector 18 by monitoring the energy of the signal output by the detector 18. Knowledge of when each beam 24 and/or 30 is impinging on the detector 18 may facilitate determination of the locations of the edges 38 and 40 of the print media 34. The media edge-detection system 12 is particularly useful for detecting top of form 38 and bottom of form 40 in full-bleed printing applications.

To poll the first sensor 18, 20, the electrical signal from the detector 18 corresponding to the first optical beam 24 from the first LED 20 is received for analysis by the media edge-detection application 14. Similarly, to poll the second sensor 18, 22, an electrical signal output by the detector 18 in response to the second optical beam 30 is received for analysis by the media edge-detection application 14. Hence, a given sensor may be polled by turning on the appropriate LED 20 and/or 22 and extracting, such as via sampling at a polling or sampling rate, the appropriate electrical signal component output from the detector 18. The electrical signal component is generated by the detector 18 in response to the optical signal output by the LED 20 or 22 associated with the sensor 18, 20 or 18, 22 that is being polled.

In the present embodiment, the sensors 18, 20 and 18, 22 are polled independently, however, they may be polled simultaneously without departing from the scope of the present invention. The sensor polling rates may be selectively varied by the media edge-detection application 14. The rate at which the sensor 18, 20 or 18, 22 is polled corresponds to the rate at which information from the sensor 18, 20 or 18, 22 is retrieved from the detector 18 by the media edge-detection application 14.

In the present embodiment, polling of a given sensor 18, 20 or 18, 22 includes sampling the output of the detector 18. The rate at which a given sensor 18, 20 or 18, 22 is polled, i.e., polling rate, is the rate at which the electrical signal at the output of the detector 18 corresponding to the optical beam 24 or 30, respectively, is sampled by the media edge-detection application 14.

In applications wherein both LED's 20 and 22 are activated simultaneously, the LED's 20 and 22 may be turned on and off or amplitude-modulated at predetermined rates or transmitted at different frequencies or at predetermined power levels and/or at different time slots to enable the media edge-detection application 14 to determine which LED's 20 or 22 are transmitting and to sample the electrical signal component associated with the sensor(s) to be polled.

Alternatively, the LED's 20 and 22 selectively transmit continuous beams that are not amplitude-modulated or turned on and off to facilitate electrical signal differentiation at the output of the detector 18. In this case, the sensor polling rate corresponds to the rate at which the media edge-detection application 14 samples the electrical signal output from the detector 18 that corresponds to the beam 24 or 30 output from the LED 20 or 22 of the sensor 18, 20 or 18, 22 being polled.

Alternatively, the LED's 20 and 22 are modulated or turned on and off at a specific rate during sampling intervals. The media edge-detection application 14 selectively samples the corresponding modulated electrical signals at a predetermined sampling rate. In this case, the sensor polling rate also corresponds to the sampling rate of the media edge-detection application 14.

Using a combination of emitters, i.e., LED's 20 and 22, that are positioned in different locations in the paper path 26, and work in concert with the single detector 18, enables more accurate sensing of the paper/media edges 38 and 40. In addition, processing time needed by the printer controller 16 to accurately sense the print media edges 38 and 40 is reduced, and more processing time is available for other important printing tasks, such as print head control.

The media edge-detection system 12 is a paper position sensor. In some applications, depending on the positioning of the media edge-detection system 12 along the paper path 26, the system 12 may operate as an Out-Of-Paper Sensor (OOPS).

The dual emitter/detector optical paths 24 and 30 are both 'line-of-sight' or 'interrupter' paths. The early-warning sensor 18, 20 and the edge detection sensor 18, 22 are emitter/detector combinations and may be considered interrupt sensors.

The first LED 20 and the second LED 22 are positioned so that the first sensing region 28 is earlier in the print media path 26 than the more accurate second sensing region 32. Note that the first emitter 20 may be positioned after second emitter 22 along the print media path 26 if appropriate optics (not shown), such as mirrors, are appropriately positioned so that the first sensing zone 28 is positioned before the second sensing zone 32 along the print media path 26.

The LED's 20 and 22 are controlled separately by the media edge-detection application 14. In the present specific embodiment, the media edge-detection application 14 ensures that the LED's 20 and 22 are not emitting simultaneously. The media edge-detection application 14, running on the printer controller 16, knows which detector response is associated with which emitter LED 20 or 22.

The second emitter LED 22, which is positioned later in the print media path 26 enables more accurate edge-detection and is the primary sensor. The detector 18 and optical paths followed by the beams 24 and 30 are configured so that interruption of the first optical path 24 warns that the leading edge 38 or trailing print media edge 40 is approaching the second sensing region 32. The early-warning sensor 18, 20 does not require fast LED turn-on times or high accuracy.

Both emitter LED's 20 and 22 are focused on the detector 18, which is biased toward the greatest response and accuracy with the primary optical path associated with the second optical beam 30 and sensing region 32. Lens and prisms (not shown) may be employed to increase warning distance and lead-time afforded by the early-warning sensor 18, 20.

The warning sensor 18, 20 is positioned earlier in the print media path 26, and consequently, can be polled much less frequently, since its function is not to accurately detect the print media edges 38 and 40. Its function is to detect incoming print media edges 38 and 40 that are entering or exiting the early detection or sensing region 28. When the print media 34 is sensed by the warning sensor 18, 20, the printer controller 16 and associated processor dedicate more processing time to polling the edge-detection sensor 18, 22 and/or to evoking more complex data algorithms running on the application 14 to enable very accurate reading of to top edge 38 and bottom edge 30 of the print media 34.

When no paper or print media 34 exists in the print media path 26, or when no edge 38 or 40 is approaching the accurate second sensing region 32, then resources of the controller 16 that would otherwise be used for high-frequency polling of the edge-detection sensor 18, 22 may be used for other important tasks. During this time, the warning sensor 18, 20 is polled at a very slow rate, and the edge-detection sensor 18, 22 is not polled.

When the warning sensor 18, 20 indicates arriving print media 34, such as by identifying the top edge 38 of a sheet of paper 34, then the media edge-detection application 14 switches from polling the warning sensor 18, 20 at a slow rate to polling the edge-detection sensor 14 at a sufficiently high rate. The high polling rate is chosen to enable sufficiently accurate edge detection to meet the needs of a given application. Faster sampling of a sensor typically provides enhanced edge-detection capability.

After the edge 38 or 40 of the print media 34 has been detected by the edge-detection sensor 18, 22, the media edge-detection application 14 switches to polling the warning sensor 18, 20 at the original, relatively slow rate. This reduction in polling rate allows the printer controller 16 and accompanying processors and/or firmware to perform other tasks much faster than they otherwise could. This may result in improved overall printer performance. For example, in a particular application, the polling rate for the edge-detection sensor 18, 22 is once every 10 microseconds, while the polling rate for the warning sensor is once per millisecond. In the present embodiment, the edge-detection sensor 18, 22 and the warning sensor 18, 20 are polled during different time intervals. Hence, when the media edge-detection application 14 is polling the edge-detection sensor 18, 22 by sampling the output of the detector 18 resulting from the second optical beam 30, the early warning sensor 18, 20 is not being sampled. Similarly, the edge-detection sensor 18, 22 is not polled during time intervals wherein the warning sensor 18, 20 is being polled.

Efficient use of the early warning sensor 18, 20 conserves processor time. The conserved processor time may be employed to sample the more accurate edge-detection sensor 18, 22 at higher frequencies than would otherwise be practical. In addition, use of the early warning sensor 18, 20 may improve the life span of the accurate sensor 18, 22, since the accurate sensor 18, 22 is used less often. Furthermore, use of certain sensors that would otherwise be impractical may now be used for the accurate sensor 18, 22. For example, certain high-power sensors; sensors with limited life spans; sensors with long warm up times; or sensors designed for limited usage may now be employed as the accurate sensor 18, 22.

Figure 2:
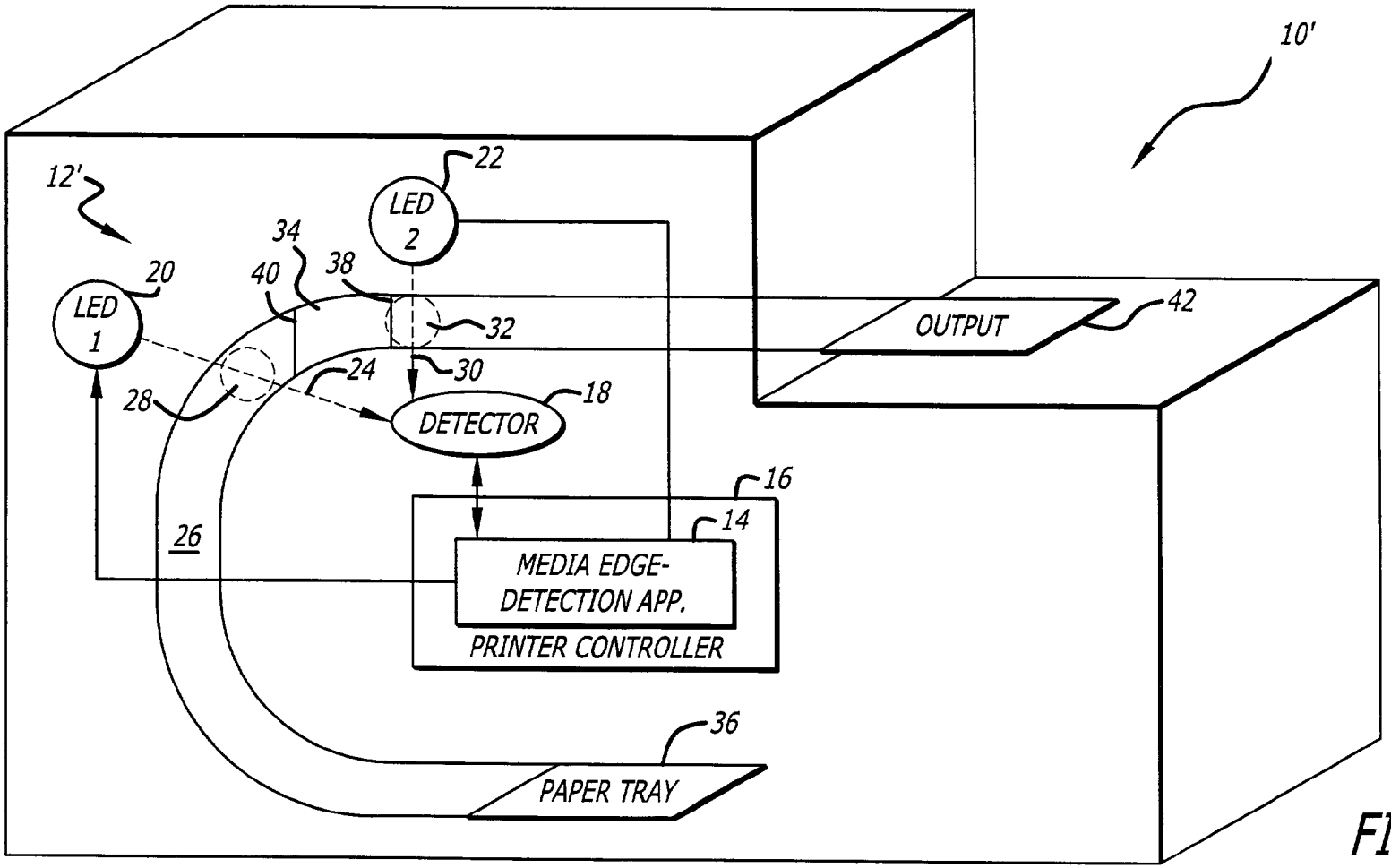
FIG. 2 is a diagram of a printer employing an alternative embodiment of the media edge-detection system of FIG. 1.

FIG. 2 is a diagram of a printer 10' employing an alternative embodiment 12' of the media edge-detection system 12 of FIG. 1. The construction and operation of the alternative media edge-detection system 12' is similar to the construction and operation of the media edge-detection system 10 of FIG. 1 with the exception that the mirror 44 of FIG. 1 is omitted, and the first LED 20 is repositioned accordingly.

Those skilled in the art will appreciate that in certain printer configurations, the location of the paper path renders the embodiment 12 of FIG. 1 more practical than the embodiment 12' of FIG. 2 and visa versa. In addition, those skilled in the art will appreciate that the positioning of the detector 18 and LED's 20 and 22 is exemplary and that different positioning may be employed without departing from the scope of the present invention. Furthermore, in an alternative implementation, the sensors 18, 20 and 18, 22 may be replaced with two separate sensors having two separate detectors.

Teachings disclosed herein may be employed in applications other than printers without departing from the scope of the present invention. For example, use of an early warning sensor to adjust the sampling rate of a more accurate sensor may be useful in military sensing systems for detecting enemy targets, air traffic control systems, assembly lines, lumber saw mills, and so on.

Thus, the present invention has been described herein with reference to a particular embodiment for a particular application. Those having ordinary skill in the art and access to the present teachings will recognize additional modifications, applications, and embodiments within the scope thereof.

It is therefore intended by the appended claims to cover any and all such applications, modifications and embodiments within the scope of the present invention.

Accordingly,

What is claimed is:

1. An efficient sensing system comprising:

first means for sensing an object;

second means for sensing the object; and third means for selectively polling said second means a plurality of times upon receipt of a signal from said first means, wherein said first means is an early warning sensor, and said second means is an accurate sensor, and wherein said third means includes a controller in communication with said accurate sensor and said early warning sensor, said controller polling said accurate sensor at a sampling rate in response to said signal.

2. The system of claim 1 wherein said controller includes means for increasing said sampling rate in response to said signal when said signal indicates detection of the object by said early warning sensor.

3. The system of claim 2 wherein said early warning sensor includes a first emitter that transmits a first beam toward a detector, said first beam associated with a first sensing region, and wherein said accurate sensor includes a second emitter that transmits a second beam toward said detector, said second beam associated with a second sensing region.

4. The system of claim 3 wherein said object includes a leading edge or trailing edge of print media.

5. The system of claim 4 wherein said first sensing region is positioned before said second sensing region in a print media path associated with said print media.

6. The system of claim 5 wherein said controller includes means for adjusting a sampling rate of said early warning sensor based on a signal received via said accurate sensor.

7. The system of claim 6 wherein said first sensing region and said second sensing region are separated by a distance greater than a distance between a leading edge and a trailing edge of print media to be sensed.

8. A media edge-detection system comprising:

a media edge sensor;

first means for determining that an edge of media is approaching said media edge sensor and providing a warning signal in response thereto; and second means for polling said media edge sensor a plurality of times at a frequency based on said warning signal.

9. The system of claim 8 wherein said media is print media.

10. The system of claim 9 wherein said first means includes an early-warning sensor that determines when an edge of print media is approaching said edge sensor.

11. The system of claim 10 wherein said early-warning sensor includes a first emitter and a detector, said first emitter providing a first beam to said detector along a first optical path associated with a first edge-detection zone.

12. The system of claim 11 wherein said edge sensor includes a second emitter and said detector, said second emitter providing a second beam to said detector along a second optical path associated with a second edge-detection zone.

13. The system of claim 12 wherein said first edge-detection zone is positioned earlier in a print media path than said second edge-detection zone.

14. The system of claim 13 wherein said first emitter is positioned earlier in a print media path than said second emitter.

15. The system of claim 14 further including third means for independently controlling said first emitter and said second emitter so that said first emitter is often not transmitting on when said second emitter is transmitting.

16. The system of claim 15 wherein said third means includes a controller capable of differentiating said first beam from said second beam, said first beam received by said detector along said first optical path from said first emitter and said second beam received by said detector along said second optical path from said second emitter.

17. The system of claim 16 wherein said first optical path is positioned so that interruption of said first optical path results in said warning signal indicating that an edge of said print media is approaching said edge sensor.

18. A media edge-detection system comprising:

a media edge sensor configured to sense the leading edge of media;

an early-warning sensor configured to sense the leading edge of the media provide a signal in response thereto;

a controller that polls said edge sensor at a predetermined frequency to accurately detect the leading edge of the media; and a program in communication with said controller that adjusts said frequency in response to said signal.

19. A sensing system comprising:

a first sensor configured to detect positioning of an object;

a second sensor configured to detect positioning of the object; and a controller configured to selectively poll the second sensor a plurality of times in response to a signal from the first sensor.

20. The sensing system of claim 19 wherein the first sensor has a first accuracy and wherein the second sensor has a second greater accuracy.

21. The system of claim 19 wherein the controller is configured to increase the frequency at which the second sensor is polled in response to the signal from the first sensor.

22. The system of claim 21 wherein the controller is configured to poll the second sensor with a zero frequency prior to receiving the signal from the first sensor.

23. The system of claim 19 wherein the second sensor is configured to detect an edge of media.

24. The system of claim 19 wherein the controller is configured to poll the first sensor at a first frequency and the second sensor at a second lesser frequency prior to receipt of the signal from the first sensor and is configured to poll the second sensor at a third frequency greater than the first frequency upon receipt of the signal from the first sensor.

25. The system of claim 24 wherein the controller is configured to poll the first sensor at a fourth frequency less than the first frequency upon receipt of the signal from the first sensor.

26. The system of claim 18, wherein the program adjusts said frequency in response to said signal from a first non-zero frequency to a second non-zero frequency.

27. A sensing system comprising:

a first sensor configured to detect positioning of an object;

a second sensor configured to detect positioning of the object; and a controller configured to selectively poll the second sensor in response to a signal from the first sensor, wherein the controller is configured to increase the frequency at which the second sensor is polled in response to the signal from the first sensor.

28. The system of claim 27, wherein the controller is configured to adjust a sampling rate of the first sensor based on a signal received from the second sensor.

* * * * *

UNITED STATES PATENT AND TRADEMARK OFFICE

CERTIFICATE OF CORRECTION

PATENT NO. : 7,596,328 B2
APPLICATION NO. : 10/421580
DATED : September 29, 2009
INVENTOR(S) : Joseph D. Barbera et al.

It is certified that error appears in the above-identified patent and that said Letters Patent is hereby corrected as shown below:

In column 9, line 25, in Claim 18, delete "media provide" and insert -- media and provide --, therefor.

Signed and Sealed this

Twentieth Day of July, 2010

David J. Kappos

David J. Kappos
*Director of the United States Patent and Trademark Office*